United States Patent [19]

Parsons

[11] 4,345,243

[45] Aug. 17, 1982

[54] APPARATUS FOR GENERATING SIGNALS FOR PRODUCING A DISPLAY OF CHARACTERS

[75] Inventor: Robert Parsons, Cambs, England

[73] Assignee: Texas Instruments Incorporated, Dallas, Tex.

[21] Appl. No.: 165,472

[22] Filed: Jul. 2, 1980

[30] Foreign Application Priority Data

Jul. 24, 1979 [GB] United Kingdom ..... 7925703

[51] Int. Cl.[3] ..... G09G 1/16

[52] U.S. Cl. ..... 340/728; 340/731; 340/744

[58] Field of Search ..... 340/728

[56] References Cited

U.S. PATENT DOCUMENTS

| | | | |
|---|---|---|---|
| 3,789,386 | 1/1974 | Itoh | 340/728 |
| 3,878,536 | 4/1975 | Gilliam | 340/728 |
| 4,079,367 | 3/1978 | Yonezawa et al. | 340/728 X |
| 4,095,216 | 6/1978 | Spicer | 340/728 |
| 4,119,954 | 10/1978 | Seitz et al. | 340/728 X |
| 4,250,502 | 2/1981 | Klaucket al. | 340/728 |

*Primary Examiner*—David L. Trafton

*Attorney, Agent, or Firm*—Mel Sharp; Gary Honeycutt; N. Rhys Merrett

[57] ABSTRACT

Apparatus for rounding of a character produced as a character segment matrix pattern for display on a raster scanned display in which a read-only memory storing the character segment matrix patterns for the characters to be displayed is arranged to produce the entire matrix pattern for a selected character in parallel at any one time. A parallel gating means selects from the matrix pattern a selected row of the matrix and also the immediately preceding row or the immediately following row depending upon which is required at the time for character rounding. The bits of the selected row are applied in parallel to a first shifting register and the bits of both rows produced by the gating means are applied in parallel to a character rounding logic circuit which is arranged to detect the presence of diagonal lines in the character and produce the appropriate rounding elements. The rounding elements are applied in parallel to a second shifting register and the two shifting registers are read out in timed relationship to one another so that their outputs can be combined to produce a video signal representing a rounded character. The parallel gating means receives in addition to a character row address a further input which determines whether it is the immediately preceding or the immediately following row which produces the second output. The signal applied to the further input indicates whether the field of the raster being scanned consists of odd or even lines, or in the case of a double height character it consists of the least significant bit of the character row address.

11 Claims, 8 Drawing Figures

APPARATUS FOR GENERATING SIGNALS FOR PRODUCING A DISPLAY OF CHARACTERS

This invention relates to apparatus for generating signals suitable for producing a display of characters on a raster scanned display means, and is of particular, but not exclusive, utility in the production of an alphanumeric display on a cathode ray tube screen in response to digital signals representing characters to be displayed.

It has been proposed ("Broadcast Teletext Specification" published September 1976, British Broadcast Corporation, Independent Broadcast Authority and British Radio Equipment Manufacturers Association) to broadcast digitally encoded data representing pages of lines of alphanumeric characters for reproduction on the screens of domestic television receivers. In the proposed systems the digital data representing a row of characters is inserted into the broadcast television signal in an otherwise blank line period preceding the conventional picture information. Over several fields of the television signal a succession of rows of characters is transmitted until finally digital data representing a page of information is stored at the receiver. The conventional television video signal can be suppressed under control of the view and an alphanumeric display derived from the stored page of information substituted for it. In order to generate the display from the digital data it is necessary to decode the data and use the decoded output to generate from a read-only memory, for example, video signals which would result in the required display as the electron beam of the tube is scanned over its raster.

Typically, the alphanumeric characters for display are stored in the read-only memory as digits representing character segments, usually dots, to be displayed in a rectangular array 9 elements high and 5 elements wide, this form of character being adopted as having the lowest resolution capable of producing an acceptably legible character in order to keep down the cost of the read-only memory. The legibility and appearance of the characters can be improved by the provision of a character rounding circuit the effect of which is to lengthen certain of the dots forming the character so as to thicken the thinner parts of the character outline between diagonally disposed dots. In order to achieve this it is necessary to have available for the character rounding logic two adjacent rows of character defining dots, and the methods proposed hitherto for obtaining the two rows at the same time have been expensive in that they required long (300 stages) shifting registers (for example, U.S. Pat. No. 3,878,536 issued Apr. 15, 1975) or two read-only memories or difficult to produce in that they required read-only memories which could be read twice in a sufficiently short time to provide the rounded character data at the rate needed to produce the character display on the CRT screen (for example, U.S. Pat. No. 4,095,216 issued on June 13, 1978).

It is an object of the present invention to provide a character rounding circuit in which the above difficulties are overcome.

According to the present invention there is provided apparatus for generating signals suitable for producing a display of characters on a raster scanned display means, the apparatus including a read-only memory having an address input for character codes and a data output for signals representing a character segment matrix pattern corresponding to the character whose code is applied to the address input, and a character rounding circuit including logic means responsive to signals representing a character segment matrix pattern derived from the read-only memory to produce signals representing additional partial character segments and means for combining the additional partial character segment signals with the character segment matrix signals derived from the read-only memory, wherein the read-only memory is arranged to produce signals in parallel representing the entire character segment matrix pattern of a character whose code is applied as address input thereto, and parallel gating means is provided to select as the output of the read-only memory signals representing a selected row of the character segment matrix pattern together with output signals representing the immediately adjacent (preceding or following) row of the character segment matrix pattern where it exists. Preferably the read-only memory and the parallel gating means are in the same integrated circuit. Typically, the partial character segments are half segments.

For a normal height display of a character the choice of the immediately preceding or the immediately following row of the character segment matrix pattern at the output of the parallel gating means is determined by whether the display is to be made during an odd or even field of the raster scan, the interlacing being used to provide the doubled resolution of the character in the vertical direction. On the other hand, if the character display is at double height the least significant bit of the displayed row of the character segment matrix is usd to determine whether the immediately preceding or the immediately following row of the pattern is produced by the parallel gating means.

Character rounding data may be derived by parallel logic receiving as inputs the selected row of the character segment matrix in parallel together with the immediately preceding or immediately following row of the matrix in parallel. The character rounding data may be transferred in parallel to a shifting register and read out serially therefrom in timed relationship to the selected row which is similarly being read out serially from a shifting register, the two serial outputs being combined to produce a rounded character video signal suitable for application to the display which suitably may comprise a cathode ray tube.

In order that the invention may be fully understood and readily carried into effect an embodiment will now be described with reference to the accompanying drawings, of which:

Figure 3A:
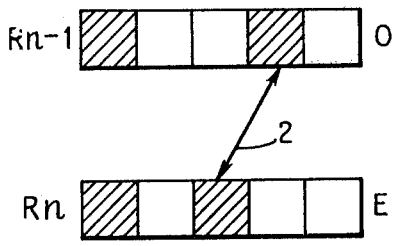
Figure 3B:
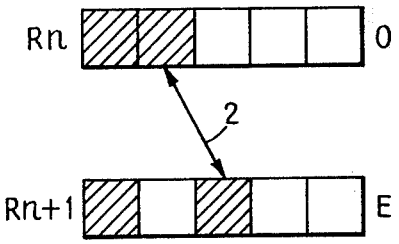
Figure 3C:
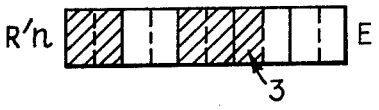
Figure 3D:
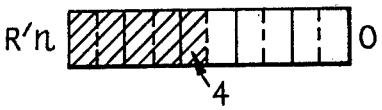

FIGS. 3*a* and 3*b* illustrate the test used herein to detect the presence of a diagonal line section in adjacent rows of a five dot wide matrix;

FIGS. 3*c* and 3*d* show respectively the second rows of FIGS. 3*a* and 3*b* with character rounding partial dots added to take into account the diagonal line sections shown in FIGS. 3*a* and 3*b;*

Figure 4:
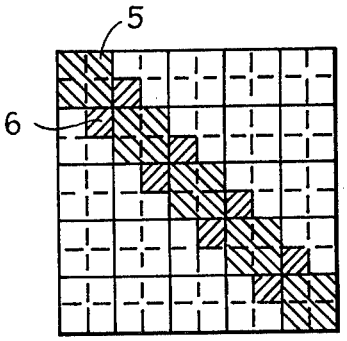
Figure 5:
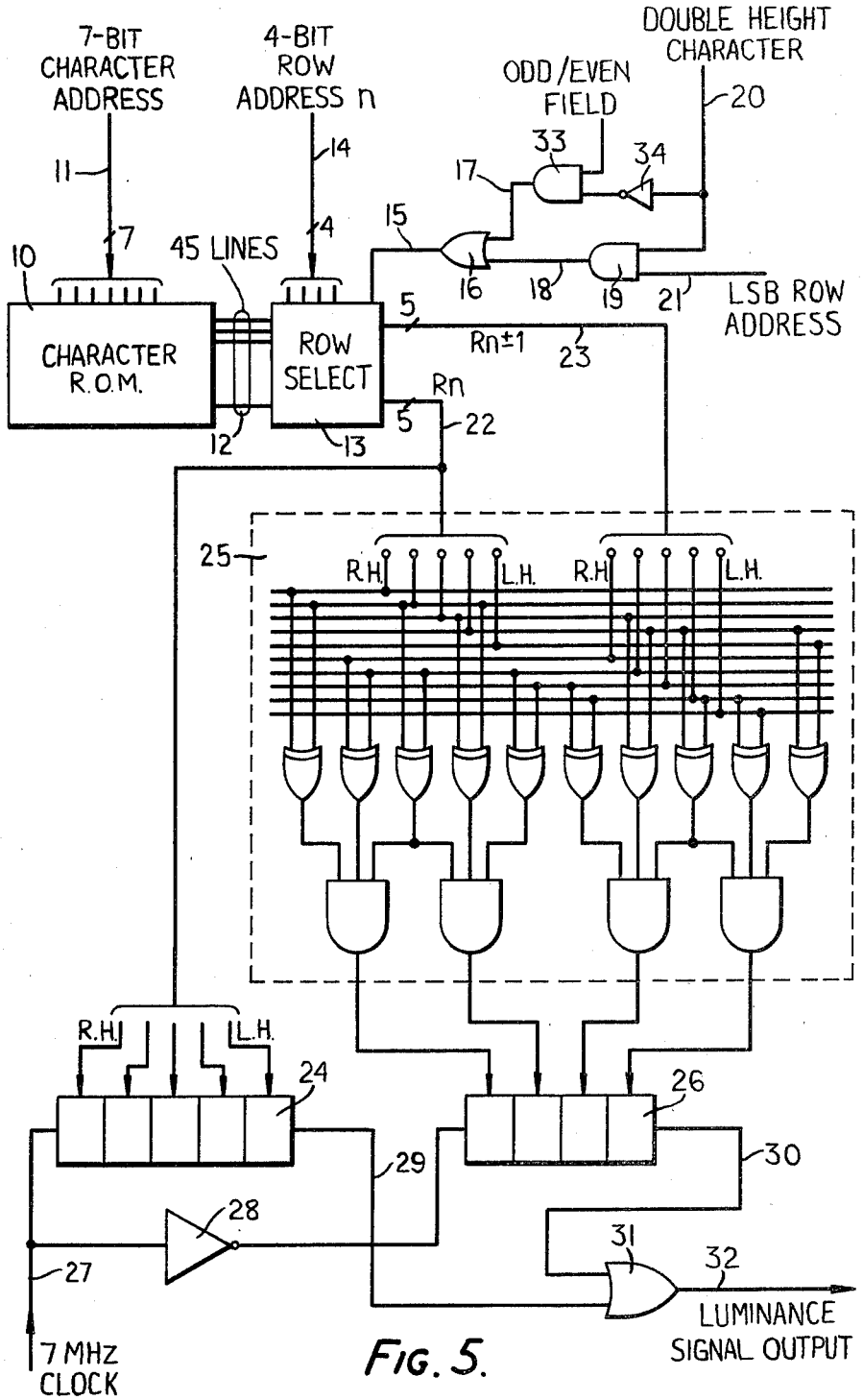

FIG. 4 shows a diagonal line section represented by a matrix with partial dots added by character rounding; and FIG. 5 is a block diagram of a circuit arrangement for producing a video signal representing characters with character rounding.

Figure 1:
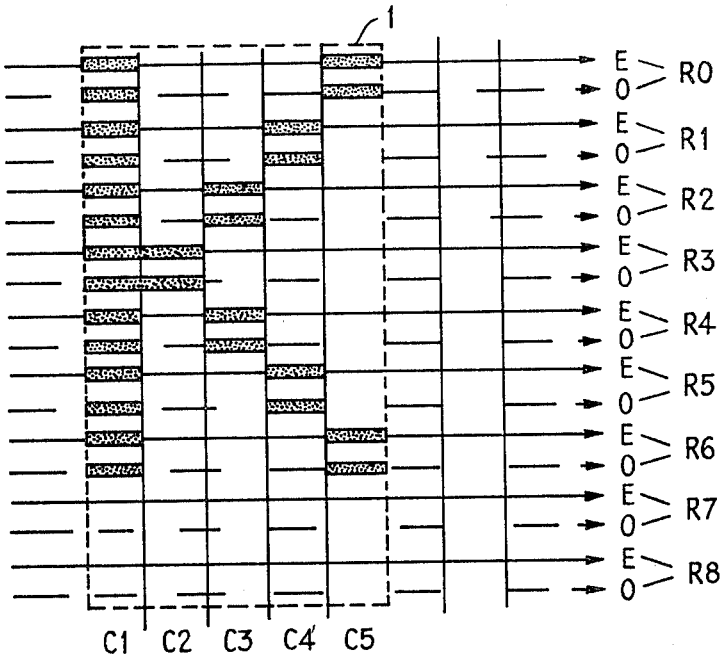
FIG. 1 is a schematic diagram of the letter 'K' as it might be generated on a raster scan display by a signal directly from a stored dot matrix pattern.
Figure 2:
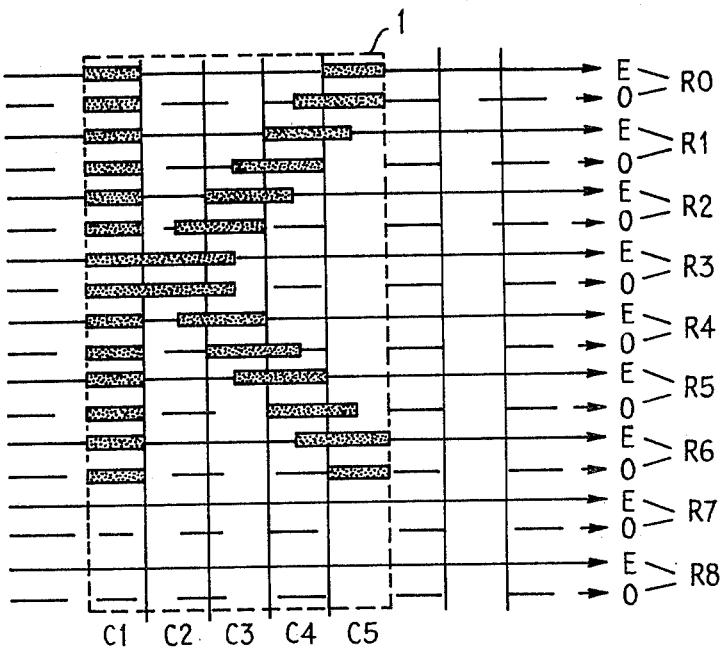
FIG. 2 is a schematic diagram of the letter 'K' generated on a raster scan display including character rounding.

Referring first to FIGS. 1 and 2, both Figures show part of a raster scan display, for example a television broadcast receiver cathode ray tube screen having a display of an alphanumeric character, the letter K, generated from a character segment matrix character generator read-only memory (ROM), for example. The character segments are referred to as dots or bars. In both cases the matrix for a single character has nine rows and five columns, each column having a width of one dot and each row being composed of two scan lines occupying consecutive fields of an interlaced raster scan. The boundaries of the matrix for a single character are shown by a close dotted line 1, the even field lines are designated E and the odd field lines (broken lines) are designated 0. In FIGS. 1 and 2 the rows of the matrix are numbered R0, R1, R2,–,R8 and the columns C1, C2,–,C5. The single character matrix shown has a space to the right of width two columns and a space below of depth two rows. The thick block lines in the matrix show where the beam intensity is modulated to generate the character display on the screen. The modulation may take the form of decreasing the beam intensity thus generating a dark character on a bright background as shown in FIGS. 1 and 2 or of increasing the beam intensity thus generating a bright character on a dark background.

In FIG. 1 the even field and odd field lines are identically modulated. In FIG. 2 the even and odd field lines are not necessarily identically modulated, modifications being made when a diagonal line section is detected in a character to be displayed. An electronic system which can be used to achieve this modulation will be described later; first the effect and precise nature of the modulation and its modification in FIG. 2 will be described. In FIG. 1 each modulation of a line occupies an integral number of columns of the matrix; in FIG. 2 this is not necessarily true. In FIG. 2 the pattern of modulation of an even field in a row Rn is derived from the pattern of modulation in the even field of row Rn and the off field of row Rn−1 of FIG. 1. If the modulation of these two rows of FIG. 1 is such as is shown in FIG. 3*a* or 3*b* there is a diagonal line section present in the character (as indicated by arrowed line 2). In the case of a diagonal line section such as that in FIG. 3*a* the form of modulation of the even field in row Rn is modified in that an extra half column width of modulation is inserted at 3 to form the row Rn shown in FIG. 3*c*. This effects a smoothing between the parts of a character in one row and the next. For an odd field line R'n the pattern of modulation is derived from the odd field line Rn and the even field line Rn+1. For an even field line R'n the pattern of modulation is derived from the even field line Rna and the odd field line Rn−1. FIGS. 3*c* and 3*d* show the half dot additions to the modulations for even and odd field lines respectively due to the presence of diagonal line sections in the character.

In FIG. 1 the lines R1 and R2 are as shown in FIG. 3*a* and the lines R3 and R4 are as shown in FIG. 3*b*. Thus in FIG. 2 the even field line R2 is as shown in FIG. 3*c* and the odd field line R3 is as shown in FIG. 3*d*. The other lines in FIG. 2 are generated in the same way. By this means the dot matrix of FIG. 2 includes the half dot additions. By this effect the reproduction of the characters is improved to make full use of the interlaced lines of the raster as illustrated schematically in FIG. 4. FIG. 4 shows a diagonal line as it would be rendered using the same modulation for both odd and even field lines; this being indicated by the leftward hatching; together with the modification which would be brought about by the use of the half dot additions as described above; the additions are indicated by rightward hatching.

The dot matrix patterns for producing displays of characters are stored in a read-only memory 10 and typically this memory stores the patterns for 96 characters and the dot matrix patterns each contain 45 elements, the matrices being 9 elements high and 5 elements wide. A seven-bit character code is applied to the read-only memory 10 via conductors 11 and are used as address information to select one of the 96 patterns stored in the read-only memory 10. The 45 bits representing a selected pattern are produced in parallel on ther 45 lines 12 by which they are applied to row select gates 13. The function of the gates 13 is to select five bits from the incoming 45 bits which represent a particular one Rn of the rows of the dot matrix pattern incoming form the read-only memory 10 and in addition the five bits of either the row immediately preceding the row Rn or of the row immediately following the row Rn. The selection is achieved in response to four-bit row address data applied via 4 parallel lines 14 in conjunction with a further bit of information applied via a conductor 15. The further bit is used to select whether the additional row the bits of which are produced as outputs in addition to the bits of the row Rn is the row immediately preceding or immediately following the row Rn. If the character is to be displayed at normal height the bit applied to the conductor 15 is derived via an OR-gate 16 and a conductor 17 from an odd/even field signal which indicates whether the odd or even lines of the raster are being described at the time. The significance of this signal will be apparent from the consideration of the description of FIGS. 1 and 2 above. If, however, the character is to be displayed at double height, then odd or even row information is used and this is applied as an input to the OR-gate 16 via a conductor 18 from an AND-gate 19 having as inputs a signal indicating that the character is to be displayed at double height which is applied via a conductor 20 and the least significant bit of the row address which is applied via a conductor 21.

In order to prevent the odd/even field signal from being applied to the row select gates 13 when a double height character signal is present an AND-gate 33 is provided to control the application of the odd/even field signal to the gate 16, the double height character signal on the conductor 20 being inverted in an inverter 34 and applied to a second input of the AND-gate 33 to effect the control.

The five bits of the row Rn appear on 5 parallel lines 22 and are applied to respective stages of a five-stage shifting register 24 and as one set of inputs to a logic circuit 25. The five bits of the row immediately preceding or immediately following the row Rn, which is referred to for convenience as Rn±1, appear on 5 parallel lines 23 and are applied as a second set of inputs to the logic circuit 25. The function of the logic circuit 25, which consists as shown of ten exclusive OR-gates and four AND-gates, is to detect the presence of diagonals as described above with reference to FIGS. 3*a* and 3*b*, in the rows Rn and Rn±1. The four AND-gates produce "1" output whenever a diagonal is detected at the four junctions between row elements respectively and the pattern of these 1's is applied from the logic circuit 25 to a four-stage shifting register 26.

A 7 MHz clock signal is applied via a conductor 27 directly to the shifting register 24 and via an inverter 28 to the shifting register 26, so that outputs of the shifting register 26 are interleaved or 180° out of phase with respect to the outputs of the shifting register 24, and the two sets of outputs which appear respectively on conductors 30 and 29 are combined in an OR-gate 31 to produce a combined luminance signal for producing a rounded character on a conductor 32. It should be noted that if the circuit is constructed using $I^2L$ technology the OR-gate 31 merely consists of a connection between the outputs of the registers 24 and 26 and does not appear as a separate circuit element and therefore does not impose any frequency limitation on the luminance signal.

In the operation of the circuit of FIG. 5, information representing characters to be displayed on a CRT screen would in any one example be derived from a random access memory, not shown, so that the seven-bit character codes are applied to the read-only memory 10 at times corresponding to the positions on the rows of characters to be displayed on the screen. Each row of characters occupies, for example, 20 lines of the television raster, i.e. 10 in each field and therefore a sequence of character codes corresponding to the characters of a displayed row is repeatedly applied nine times to the read-only memory 10, and as the row address n increases from 1 to 9 the gates 13 select as the output Rn the corresponding five bits of the row of the dot matrix representing a particular character at the time. As explained above, the gates 13 also select the row Rn+1 or the row Rn−1, depending on whether the field is the field of odd numbered lines or the field of even numbered lines (for a character or normal height).

It will be apparent that the signals on the sets of 5 parallel lines 22 and 23 could, for example, resemble the patterns shown in FIGS. *3a* and *3b*, and from a consideration of the description given above it will be understood how the character rounding data in the form of half dots is generated when diagonals are detected by the logic circuit 25. Preferably the outputs of the shifting registers 24 and 26 consist of an unbroken "1" level if two or more 1's occur adjacent to each other. Thus the inversion of the clock signal by the inventer 28 has the effect of a half time delay so that the character rounding bits stored in the shifting register 26 appear at such times as to overlap half of both of the bits of the data from the register 24 which gave rise to the particular character rounding bit. Consideration of FIG. 4 will make it clear how the character rounding data represented in that Figure by the leftward hatched areas 6 has a half dot time shift relative to the dots of the dot matrix describing the character which are shown with rightward hatching and have the reference 5. It should be noted that the effect of the OR-gate 31 is to produce the same output if a "1" appears on either or both of the conductors 30, so that the overlap of a "1" from the register 24 with the "1" from the register 26 does not appear at a different level from the presence of "1" from either of those registers alone.

Because the whole of the dot matrix pattern representing a character is derived in parallel from the read-only memory 10 and the two rows of the pattern required at any one time are derived from the pattern simultaneously, it will be clear that the maximum length of time is available for reading the dot matrix pattern from the read-only memory and for performing the logical operations necessary to derive the character rounding data because the need to read the read-only memory twice is avoided. Moreover the invention avoids the need to provide two read-only memories because the gates 13 enable the two rows required to be selected simultaneously. In addition the derivation of the character rounding data prior to its storage in the shifting register 26 avoids the need for high speed logic capable of working at 7 MHz which would be required if the character rounding were performed on the outputs of the shifting registers 24 and 26.

The circuit of the invention is particularly suitable for construction in integrated circuit form, particularly using $I^2L$ technology, and whilst it would be advantageous to have the entire circuit form in a single integrated circuit a practical arrangement could be made in which only the read-only memory 10 and the row select gate 13 were on the same integrated circuit.

What is claimed is:

1. Apparatus for generating signals suitable for producing a display of characters on a raster scanned display means, the apparatus including a read-only memory having an address input for character codes and a data output for signals representing a character segment matrix pattern identified by a character corresponding to a character code applied to said address input; and a character rounding circuit including logic means responsive to signals representing a character segment matrix pattern derived from the read-only memory to produce signals representing additional partial character segments and means for combining the additional partial character segment signals with the character segment matrix signals derived from the read-only memory, means for operating the read-only memory to produce output signals in parallel representing the entire character segment matrix pattern of a character whose code is applied as address input thereto, and parallel gating means for selecting as the output of the read-only memory, output signals representing a selected row of the character segment matrix pattern simultaneously with output signals representing the immediately adjacent row of the character segment matrix pattern where it exists.

2. Apparatus according to claim 1, including a first shifting register means for receiving in parallel the output signals of the read-only memory representing the selected row of the character segment matrix pattern, logic circuit means for receiving in parallel the output signals from the read-only memory representing both the selected row and the immediately adjacent row of the dot matrix pattern for producing character rounding data is in parallel, second shifting register means for receiving in parallel in character rounding data, and means for shifting data out of the first and second shifting registers in timed relationship to produce a video signal representing a rounded character.

3. Apparatus according to claim 2, wherein the logic circuit means includes gates for detecting the presence of diagonal lines in the character segment matrix pattern and for producing an output representing an additional character segment corresponding to each position at which a diagonal line is detected.

4. Apparatus according to claim 3, including means for shifting data out of the second shifting register means half a character segment time period out of phase with the shifting of data out of the first shifting register means, and means for combining the outputs shifted from first and second shifting register means to produce the video signal.

5. Apparatus according to claim 1, wherein the parallel gating means has a first set of inputs for a character row address and a second input for selecting the immediately preceding or the immediately following row of the character segment matrix pattern for inclusion in the selected output.

6. Apparatus according to claim 5, including means for selectively applying to the second input of the parallel gating means (a) a signal indicating whether the odd or the even lines of a raster are being scanned or (b) a signal representing the least significant bit of the character row address for a double height character to be produced.

7. Apparatus including raster scanned display means for producing a display of alpha-numeric characters in response to character generation video signals, including means for generating said character generation video signals comprising:

(a) a read only memory means for storing data representing respective characters for display and having an address input for character codes and a data output for signals representing a character segment matrix pattern of a stored character identified by a character code applied to address input; and a character rounding circuit including means for operating the read only memory to produce output signals in parallel representing the entire character segment matrix pattern of a stored character identified by a code applied as address input thereto; parallel gating means having inputs for selecting a particular character row address and applying output signals of the read only memory corresponding to said row address in parallel to first shifting register means and to logic circuit means, and for selecting the preceding or succeeding row of the character segment matrix next adjacent to the row corresponding to said row address and applying output signals of the read only memory corresponding to said next adjacent row in parallel to said logic circuit means simultaneously with said output signals common to said particular row address; means for enabling said inputs of said gating means; said logic circuit means responsive to said selected row and next adjacent row output signals to generate character rounding data; second shifting register means for receiving in parallel said character rounding data from said logic circuit means; and means for serially shifting data out of said first and second shifting register means to produce a character generation video signal representing a rounded character.

8. Apparatus according to claim 7, including means for selectively applying to the second input of the parallel gating means, (a) a signal indicating whether the odd or the even lines of a raster are being scanned or (b) a signal representing the least significant bit of the character row address for a double height character to be produced.

9. Apparatus according to claim 7 or claim 8, wherein the logic circuit means includes gates for detecting the presence of diagonal lines in the character segment matrix pattern and for producing an output representing an additional character segment corresponding to each position at which a diagonal line is detected.

10. Apparatus according to claim 9, including means for shifting data out of the second shifting register means half a character segment time period out of phase with the shifting of data out of the first shifting register means, and means for combining the outputs shifted from the first and second shifting register means to produce the character generation video signal.

11. Apparatus according to claim 7, wherein the character rounding data comprises fractional length character segment data.

* * * * *